US009741357B2

(12) United States Patent
Gao et al.

(10) Patent No.: US 9,741,357 B2
(45) **Date of Patent: *Aug. 22, 2017**

(54) VERY SHORT PITCH DETECTION AND CODING

(71) Applicant: HUAWEI TECHNOLOGIES CO., LTD., Shenzhen, Guangdong (CN)

(72) Inventors: Yang Gao, Mission Viejo, CA (US); Fengyan Qi, Shenzhen (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 126 days.

This patent is subject to a terminal disclaimer.

(21) Appl. No.: 14/744,452

(22) Filed: Jun. 19, 2015

(65) Prior Publication Data

US 2015/0287420 A1 Oct. 8, 2015

Related U.S. Application Data

(63) Continuation of application No. 13/724,769, filed on Dec. 21, 2012, now Pat. No. 9,099,099.

(60) Provisional application No. 61/578,398, filed on Dec. 21, 2011.

(51) Int. Cl.

| | |
|---|---|
| ***G10L 19/00*** | (2013.01) |
| ***G10L 21/003*** | (2013.01) |
| ***G10L 25/90*** | (2013.01) |
| ***G10L 25/21*** | (2013.01) |
| ***G10L 25/06*** | (2013.01) |
| *G10L 19/09* | (2013.01) |

(52) U.S. Cl.

CPC ..... *G10L 21/003* (2013.01); *G10L 19/00* (2013.01); *G10L 25/06* (2013.01); *G10L 25/21* (2013.01); *G10L 25/90* (2013.01); *G10L 19/09* (2013.01)

(58) Field of Classification Search

CPC ..... G10L 25/90; G10L 19/08
USPC ..... 704/207
See application file for complete search history.

(56) References Cited

U.S. PATENT DOCUMENTS

| | | | | |
|---|---|---|---|---|
| 5,960,386 | A | 9/1999 | Janiszewski et al. | |
| 6,330,533 | B2 | 12/2001 | Su et al. | |
| 6,345,248 | B1 * | 2/2002 | Su | G10L 19/08 704/207 |
| 6,470,311 | B1 | 10/2002 | Moncur | |
| 6,574,593 | B1 | 6/2003 | Gao et al. | |

(Continued)

FOREIGN PATENT DOCUMENTS

| | | | |
|---|---|---|---|
| CN | 101183526 | A | 5/2008 |
| CN | 101286319 | A | 10/2008 |

(Continued)

*Primary Examiner* — Daniel Abebe

(57) ABSTRACT

System and method embodiments are provided for very short pitch detection and coding for speech or audio signals. The system and method include detecting whether there is a very short pitch lag in a speech or audio signal that is shorter than a conventional minimum pitch limitation using a combination of time domain and frequency domain pitch detection techniques. The pitch detection techniques include using pitch correlations in time domain and detecting a lack of low frequency energy in the speech or audio signal in frequency domain. The detected very short pitch lag is coded using a pitch range from a predetermined minimum very short pitch limitation that is smaller than the conventional minimum pitch limitation.

22 Claims, 9 Drawing Sheets

(56) References Cited

U.S. PATENT DOCUMENTS

| | | | | |
|---|---|---|---|---|
| 7,521,622 | B1 | 4/2009 | Zhang | |
| 8,812,306 | B2 * | 8/2014 | Kawashima | G10L 19/005 370/230 |
| 2003/0200092 | A1 | 10/2003 | Gao et al. | |
| 2008/0288246 | A1 * | 11/2008 | Su | G10L 19/09 704/207 |
| 2010/0063804 | A1 | 3/2010 | Sato et al. | |
| 2010/0070270 | A1 | 3/2010 | Gao | |
| 2010/0174534 | A1 | 7/2010 | Vos | |
| 2011/0125505 | A1 | 5/2011 | Vaillancourt et al. | |
| 2012/0265525 | A1 | 10/2012 | Moriya et al. | |

FOREIGN PATENT DOCUMENTS

| | | | |
|---|---|---|---|
| CN | 101622664 | A | 1/2010 |
| JP | 2013137574 | A | 7/2013 |

* cited by examiner

Example of a regular wideband spectrum with doubling pitch lag coding

VERY SHORT PITCH DETECTION AND CODING

CROSS-REFERENCE TO RELATED APPLICATIONS

This application is a continuation of U.S. patent application Ser. No. 13/724,769, filed on Dec. 21, 2012, which claims priority to U.S. Provisional Application Ser. No. 61/578,398 filed on Dec. 21, 2011, entitled "Very Short Pitch Detection, all of which are hereby incorporated by reference in their entireties.

TECHNICAL FIELD

The present invention relates generally to the field of signal coding and, in particular embodiments, to a system and method for very short pitch detection and coding.

BACKGROUND

Traditionally, parametric speech coding methods make use of the redundancy inherent in the speech signal to reduce the amount of information to be sent and to estimate the parameters of speech samples of a signal at short intervals. This redundancy can arise from the repetition of speech wave shapes at a quasi-periodic rate and the slow changing spectral envelop of speech signal. The redundancy of speech wave forms may be considered with respect to different types of speech signal, such as voiced and unvoiced. For voiced speech, the speech signal is substantially periodic. However, this periodicity may vary over the duration of a speech segment, and the shape of the periodic wave may change gradually from segment to segment. A low bit rate speech coding could significantly benefit from exploring such periodicity. The voiced speech period is also called pitch, and pitch prediction is often named Long-Term Prediction (LTP). As for unvoiced speech, the signal is more like a random noise and has a smaller amount of predictability.

SUMMARY OF THE INVENTION

In accordance with an embodiment, a method for very short pitch detection and coding implemented by an apparatus for speech or audio coding includes detecting in a speech or audio signal a very short pitch lag shorter than a conventional minimum pitch limitation, using a combination of time domain and frequency domain pitch detection techniques including using pitch correlation and detecting a lack of low frequency energy. The method further includes and coding the very short pitch lag for the speech or audio signal in a range from a minimum very short pitch limitation to the conventional minimum pitch limitation, wherein the minimum very short pitch limitation is predetermined and is smaller than the conventional minimum pitch limitation.

In accordance with another embodiment, a method for very short pitch detection and coding implemented by an apparatus for speech or audio coding includes detecting in time domain a very short pitch lag of a speech or audio signal shorter than a conventional minimum pitch limitation by using pitch correlations, further detecting the existence of the very short pitch lag in frequency domain by detecting a lack of low frequency energy in the speech or audio signal, and coding the very short pitch lag for the speech or audio signal using a pitch range from a predetermined minimum very short pitch limitation that is smaller than the conventional minimum pitch limitation.

In yet another embodiment, an apparatus that supports very short pitch detection and coding for speech or audio coding includes a processor and a computer readable storage medium storing programming for execution by the processor. The programming including instructions to detect in a speech signal a very short pitch lag shorter than a conventional minimum pitch limitation using a combination of time domain and frequency domain pitch detection techniques including using pitch correlation and detecting a lack of low frequency energy, and code the very short pitch lag for the speech signal in a range from a minimum very short pitch limitation to the conventional minimum pitch limitation, wherein the minimum very short pitch limitation is predetermined and is smaller than the conventional minimum pitch limitation.

BRIEF DESCRIPTION OF THE DRAWINGS

For a more complete understanding of the present invention, and the advantages thereof, reference is now made to the following descriptions taken in conjunction with the accompanying drawing, in which.

DETAILED DESCRIPTION OF ILLUSTRATIVE EMBODIMENTS

The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

For either voiced or unvoiced speech case, parametric coding may be used to reduce the redundancy of the speech segments by separating the excitation component of speech signal from the spectral envelop component. The slowly changing spectral envelope can be represented by Linear Prediction Coding (LPC), also called Short-Term Prediction (STP). A low bit rate speech coding could also benefit from exploring such a Short-Term Prediction. The coding advantage arises from the slow rate at which the parameters change. Further, the voice signal parameters may not be significantly different from the values held within few milliseconds. At the sampling rate of 8 kilohertz (kHz), 12.8 kHz or 16 kHz, the speech coding algorithm is such that the nominal frame duration is in the range of ten to thirty milliseconds. A frame duration of twenty milliseconds may be a common choice. In more recent well-known standards, such as G.723.1, G.729, G.718, EFR, SMV, AMR, VMR-WB or AMR-WB, a Code Excited Linear Prediction Technique (CELP) has been adopted. CELP is a technical combination of Coded Excitation, Long-Term Prediction and Short-Term Prediction. CELP Speech Coding is a very popular algorithm principle in speech compression area although the details of CELP for different codec could be significantly different.

Figure 1:
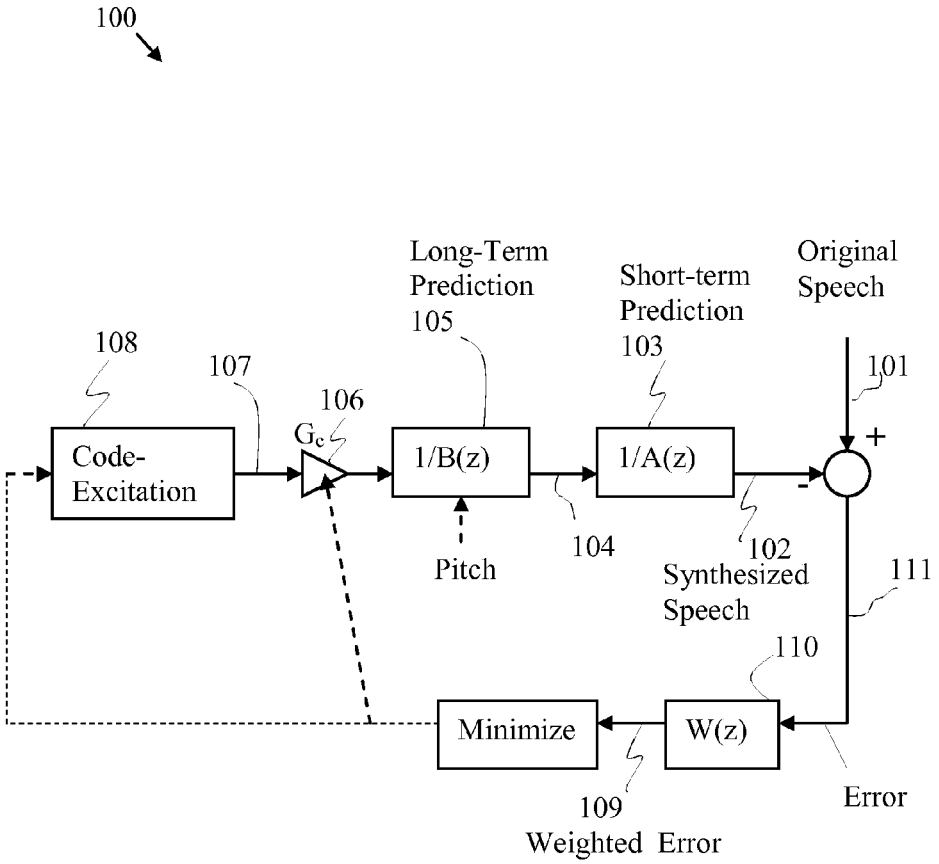
FIG. 1 is a block diagram of a Code Excited Linear Prediction Technique (CELP) encoder.

FIG. 1 shows an example of a CELP encoder 100, where a weighted error 109 between a synthesized speech signal 102 and an original speech signal 101 may be minimized by using an analysis-by-synthesis approach. The CLP encoder 100 performs different operations or functions. The function W(z) corresponds is achieved by an error weighting filter 110. The function 1/B(z) is achieved by a long-term linear prediction filter 105. The function 1/A(z) is achieved by a short-term linear prediction filter 103. A coded excitation 107 from a coded excitation block 108, which is also called fixed codebook excitation, is scaled by a gain $G_c$ 106 before passing through the subsequent filters. A short-term linear prediction filter 103 is implemented by analyzing the original signal 101 and represented by a set of coefficients:

$$A(z) = \sum_{i=1}^{P} 1 + a_i \cdot z^{-i}, \quad i = 1, 2, \ldots, P \tag{1}$$

The error weighting filter 110 is related to the above short-term linear prediction filter function. A typical form of the weighting filter function could be $$W(z) = \frac{A(z/\alpha)}{1 - \beta \cdot z^{-1}}, \tag{2}$$

where $\beta<\alpha$, $0<\beta<1$, and $0<\alpha\leq 1$. The long-term linear prediction filter 105 depends on signal pitch and pitch gain. A pitch can be estimated from the original signal, residual signal, or weighted original signal. The long-term linear prediction filter function can be expressed as $$W(z) = \frac{A(z/\alpha)}{1 - \beta \cdot z^{-1}}, \tag{3}$$

The coded excitation 107 from the coded excitation block 108 may consist of pulse-like signals or noise-like signals, which are mathematically constructed or saved in a codebook. A coded excitation index, quantized gain index, quantized long-term prediction parameter index, and quantized short-term prediction parameter index may be transmitted from the encoder 100 to a decoder.

Figure 2:
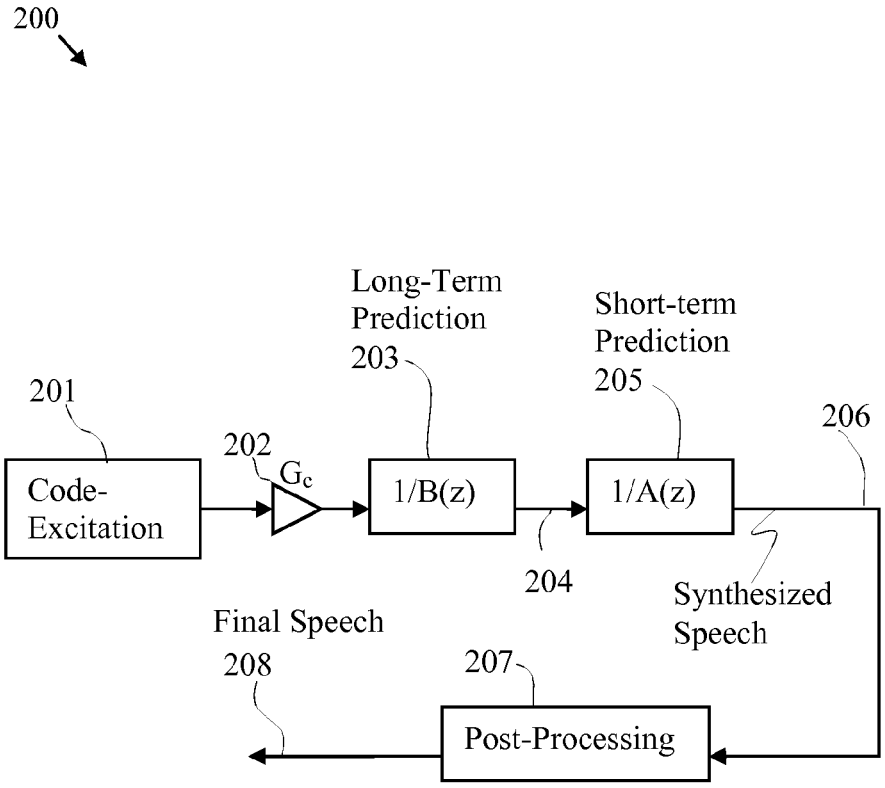
FIG. 2 is a block diagram of a decoder corresponding to the CELP encoder of FIG. 1.

FIG. 2 shows an example of a decoder 200, which may receive signals from the encoder 100. The decoder 200 includes a post-processing block 207 that outputs a synthesized speech signal 206. The decoder 200 comprises a combination of multiple blocks, including a coded excitation block 201, a long-term linear prediction filter 203, a short-term linear prediction filter 205, and a post-processing block 207. The blocks of the decoder 200 are configured similar to the corresponding blocks of the encoder 100. The post-processing block 207 may comprise short-term post-processing and long-term post-processing functions.

Figure 3:
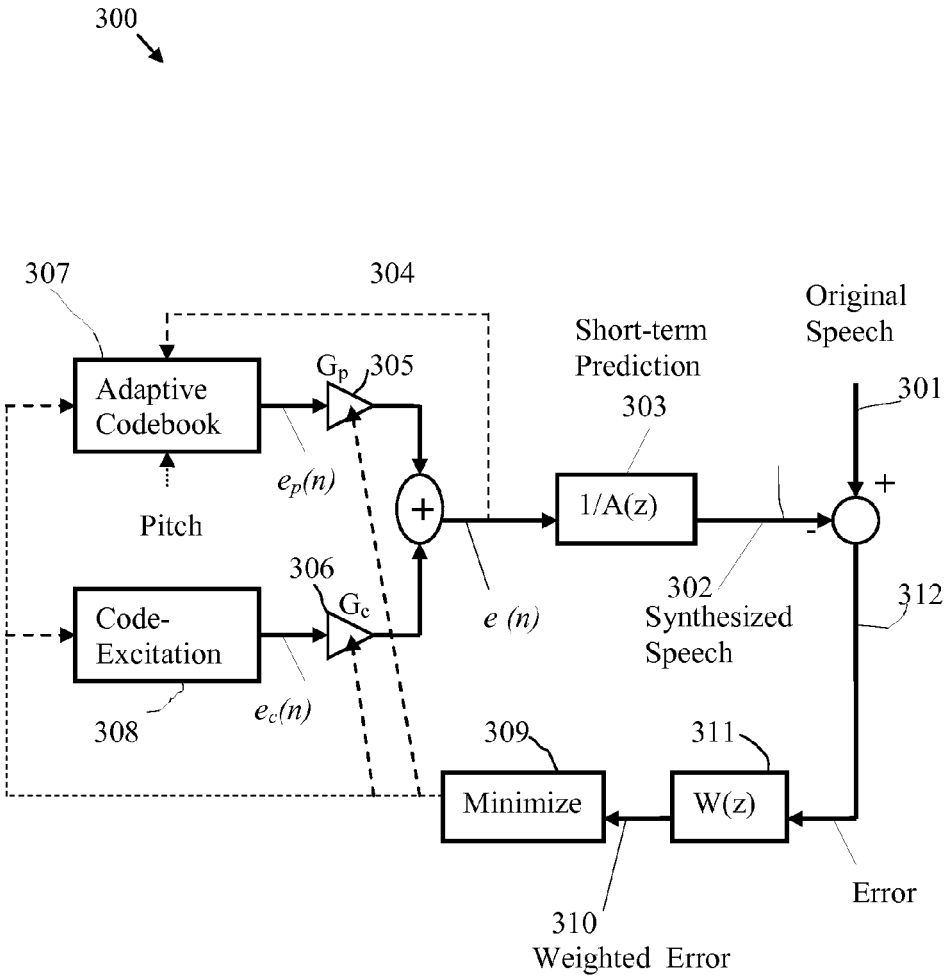
FIG. 3 is a block diagram of another CELP encoder with an adaptive component.

FIG. 3 shows another CELP encoder 300 which implements long-term linear prediction by using an adaptive codebook block 307. The adaptive codebook block 307 uses a past synthesized excitation 304 or repeats a past excitation pitch cycle at a pitch period. The remaining blocks and components of the encoder 300 are similar to the blocks and components described above. The encoder 300 can encode a pitch lag in integer value when the pitch lag is relatively large or long. The pitch lag may be encoded in a more precise fractional value when the pitch is relatively small or short. The periodic information of the pitch is used to generate the adaptive component of the excitation (at the adaptive codebook block 307). This excitation component is then scaled by a gain $G_p$ 305 (also called pitch gain). The two scaled excitation components from the adaptive codebook block 307 and the coded excitation block 308 are added together before passing through a short-term linear prediction filter 303. The two gains ($G_p$ and $G_c$) are quantized and then sent to a decoder.

Figure 4:
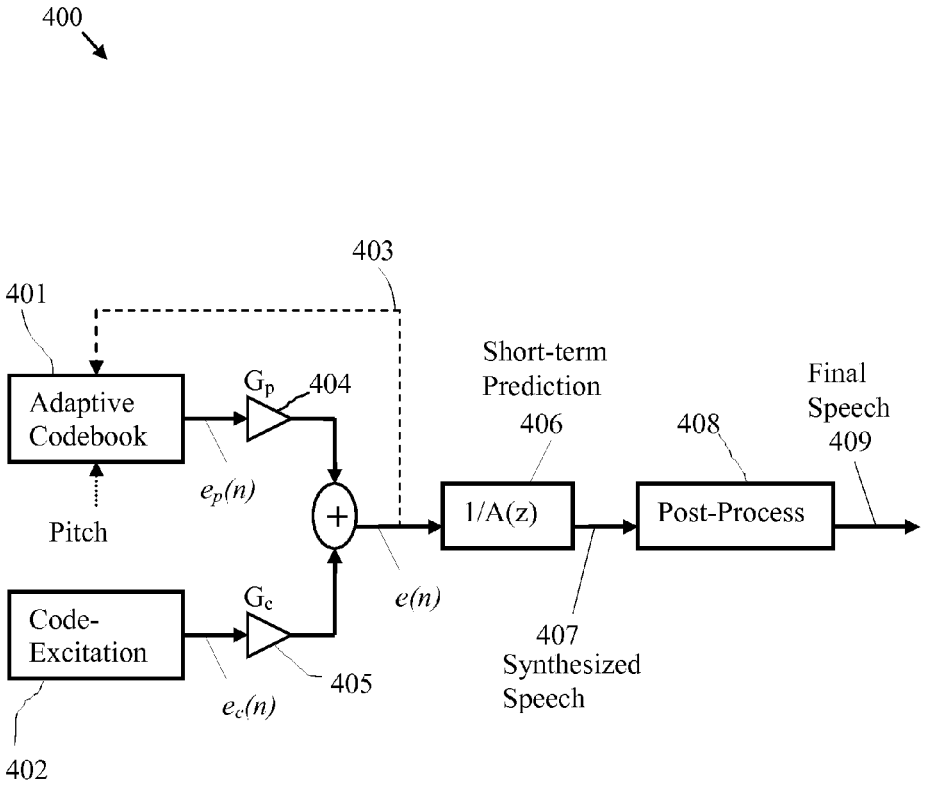
FIG. 4 is a block diagram of another decoder corresponding to the CELP encoder of FIG. 3.

FIG. 4 shows a decoder 400, which may receive signals from the encoder 300. The decoder 400 includes a post-processing block 408 that outputs a synthesized speech signal 407. The decoder 400 is similar to the decoder 200 and the components of the decoder 400 may be similar to the corresponding components of the decoder 200. However, the decoder 400 comprises an adaptive codebook block 307 in addition to a combination of other blocks, including a coded excitation block 402, an adaptive codebook 401, a short-term linear prediction filter 406, and post-processing block 408. The post-processing block 408 may comprise short-term post-processing and long-term post-processing functions. Other blocks are similar to the corresponding components in the decoder 200.

Long-Term Prediction can be effectively used in voiced speech coding due to the relatively strong periodicity nature of voiced speech. The adjacent pitch cycles of voiced speech may be similar to each other, which means mathematically that the pitch gain $G_p$ in the following excitation expression is relatively high or close to 1, $$e(n)=G_p \cdot e_p(n)+G_c \cdot e_c(n) \tag{4}$$

where $e_p(n)$ is one subframe of sample series indexed by n, and sent from the adaptive codebook block 307 or 401 which uses the past synthesized excitation 304 or 403. The parameter $e_p(n)$ may be adaptively low-pass filtered since low frequency area may be more periodic or more harmonic than high frequency area. The parameter $e_c(n)$ is sent from the coded excitation codebook 308 or 402 (also called fixed codebook), which is a current excitation contribution. The parameter $e_c(n)$ may also be enhanced, for example using high pass filtering enhancement, pitch enhancement, dispersion enhancement, formant enhancement, etc. For voiced speech, the contribution of $e_p(n)$ from the adaptive codebook block 307 or 401 may be dominant and the pitch gain $G_p$ 305 or 404 is around a value of 1. The excitation may be updated for each subframe. For example, a typical frame size is about 20 milliseconds and a typical subframe size is about 5 milliseconds.

Figure 5:
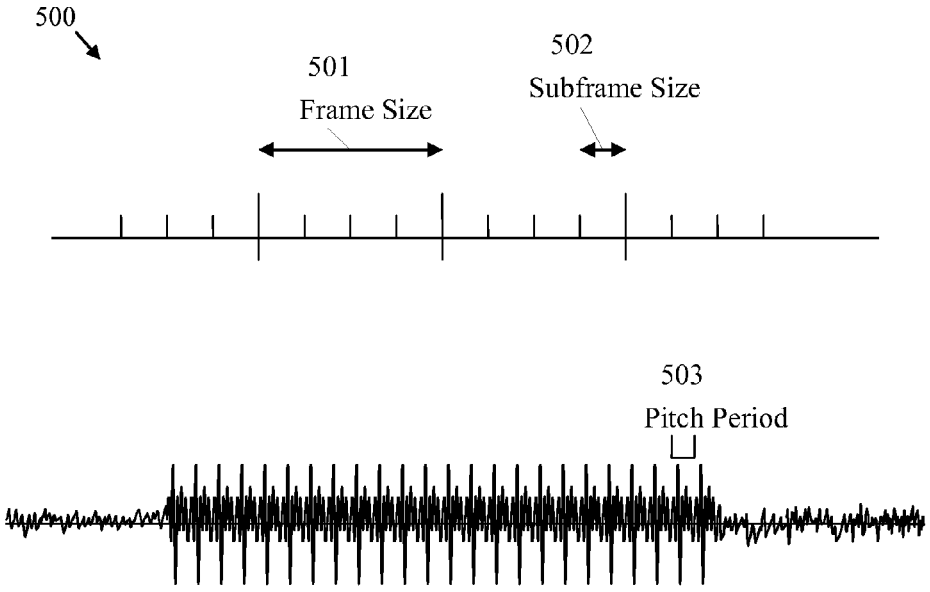
FIG. 5 is an example of a voiced speech signal where a pitch period is smaller than a subframe size and a half frame size.
Figure 6:
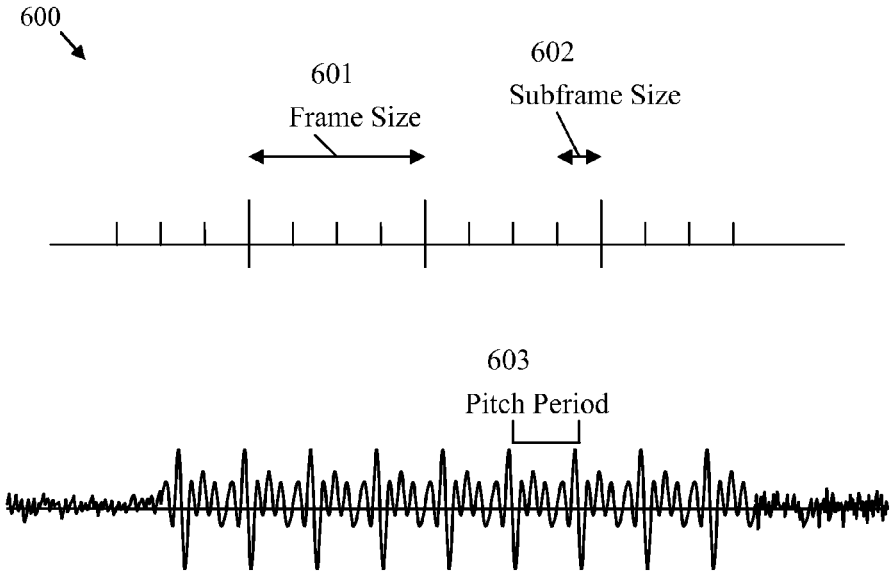
FIG. 6 is an example of a voiced speech signal where a pitch period is larger than a subframe size and smaller than a half frame size.

For typical voiced speech signals, one frame may comprise more than 2 pitch cycles. FIG. 5 shows an example of a voiced speech signal 500, where a pitch period 503 is smaller than a subframe size 502 and a half frame size 501. FIG. 6 shows another example of a voiced speech signal 600, where a pitch period 603 is larger than a subframe size 602 and smaller than a half frame size 601.

The CELP is used to encode speech signal by benefiting from human voice characteristics or human vocal voice production model. The CELP algorithm has been used in various ITU-T, MPEG, 3GPP, and 3GPP2 standards. To encode speech signals more efficiently, speech signals may be classified into different classes, where each class is encoded in a different way. For example, in some standards such as G.718, VMR-WB or AMR-WB, speech signals arr classified into UNVOICED, TRANSITION, GENERIC, VOICED, and NOISE classes of speech. For each class, a LPC or STP filter is used to represent a spectral envelope, but the excitation to the LPC filter may be different. UNVOICED and NOISE classes may be coded with a noise excitation and some excitation enhancement. TRANSITION class may be coded with a pulse excitation and some excitation enhancement without using adaptive codebook or LTP. GENERIC class may be coded with a traditional CELP approach, such as Algebraic CELP used in G.729 or AMR-WB, in which one 20 millisecond (ms) frame contains four 5 ms subframes. Both the adaptive codebook excitation component and the fixed codebook excitation component are produced with some excitation enhancement for each subframe. Pitch lags for the adaptive codebook in the first and third subframes are coded in a full range from a minimum pitch limit PIT_MIN to a maximum pitch limit PIT_MAX, and pitch lags for the adaptive codebook in the second and fourth subframes are coded differentially from the previous coded pitch lag. VOICED class may be coded slightly different from GENERIC class, in which the pitch lag in the first subframe is coded in a full range from a minimum pitch limit PIT_MIN to a maximum pitch limit PIT_MAX, and pitch lags in the other subframes are coded differentially from the previous coded pitch lag. For example, assuming an excitation sampling rate of 12.8 kHz, the PIT_MIN value can be 34 and the PIT_MAX value can be 231.

CELP codecs (encoders/decoders) work efficiently for normal speech signals, but low bit rate CELP codecs may fail for music signals and/or singing voice signals. For stable voiced speech signals, the pitch coding approach of VOICED class can provide better performance than the pitch coding approach of GENERIC class by reducing the bit rate to code pitch lags with more differential pitch coding. However, the pitch coding approach of VOICED class or GENERIC class may still have a problem that performance is degraded or is not good enough when the real pitch is substantially or relatively very short, for example, when the real pitch lag is smaller than PIT_MIN. A pitch range from PIT_MIN=34 to PIT_MAX=231 for $F_s$=12.8 kHz sampling frequency may adapt to various human voices. However, the real pitch lag of typical music or singing voiced signals can be substantially shorter than the minimum limitation PIT_MIN=34 defined in the CELP algorithm. When the real pitch lag is P, the corresponding fundamental harmonic frequency is $F0=F_s/P$, where $F_s$ is the sampling frequency and F0 is the location of the first harmonic peak in spectrum. Thus, the minimum pitch limitation PIT_MIN may actually define the maximum fundamental harmonic frequency limitation $F_{MIN}=F_s/PIT_MIN$ for the CELP algorithm.

Figure 7:
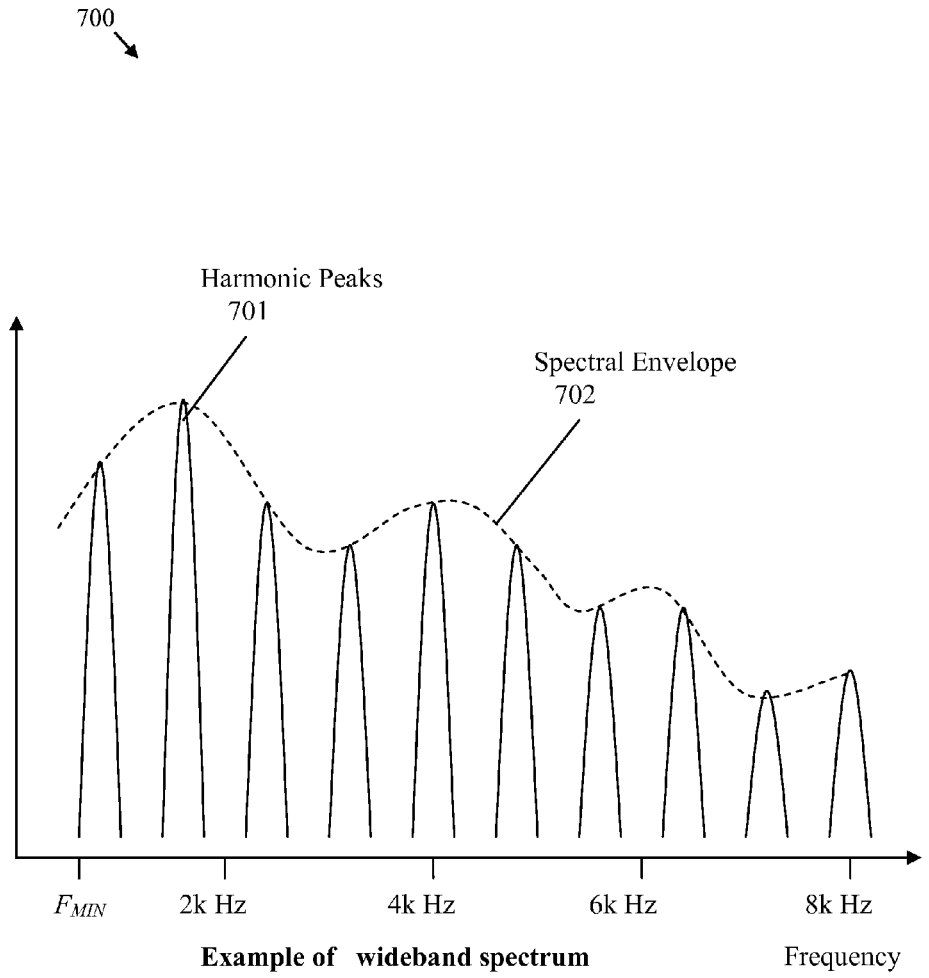
FIG. 7 shows an example of a spectrum of a voiced speech signal.
Figure 8:
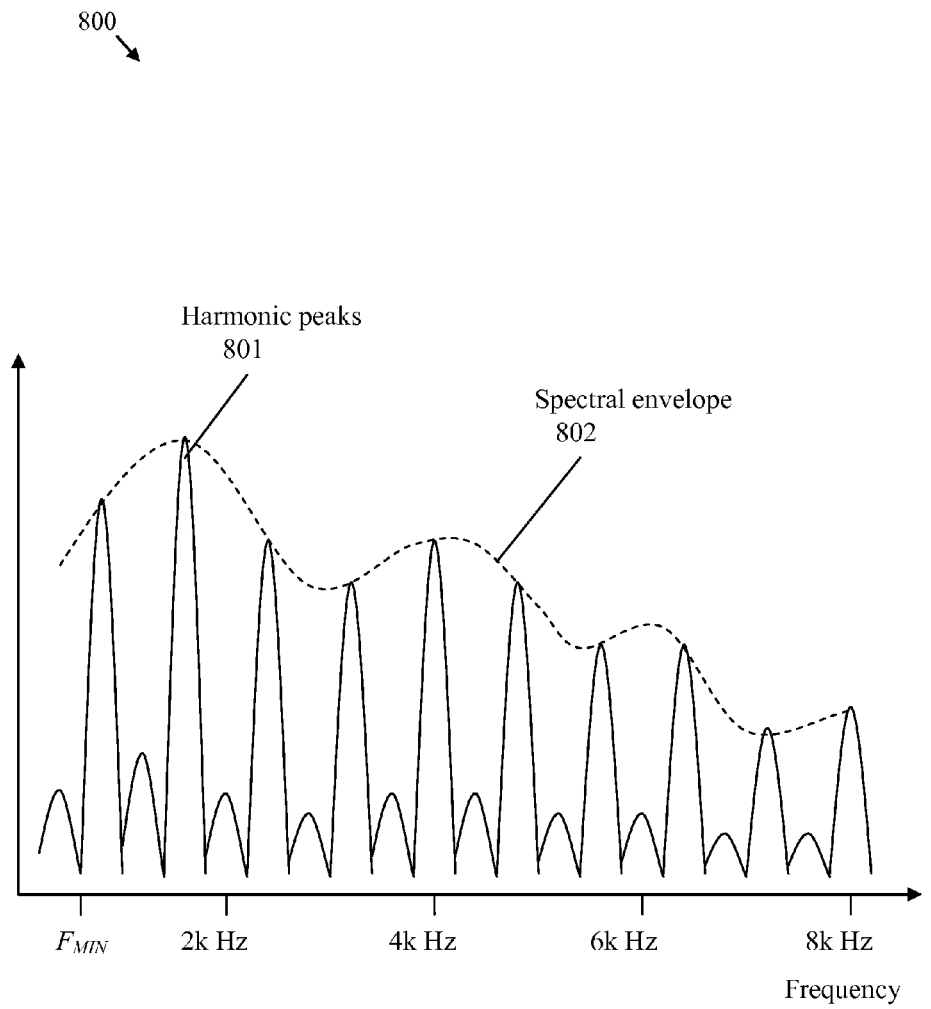
FIG. 8 shows an example of a spectrum of the same signal of FIG. 7 with doubling pitch lag coding.

FIG. 7 shows an example of a spectrum 700 of a voiced speech signal comprising harmonic peaks 701 and a spectral envelope 702. The real fundamental harmonic frequency (the location of the first harmonic peak) is already beyond the maximum fundamental harmonic frequency limitation $F_{MIN}$ such that the transmitted pitch lag for the CELP algorithm is equal to a double or a multiple of the real pitch lag. The wrong pitch lag transmitted as a multiple of the real pitch lag can cause quality degradation. In other words, when the real pitch lag for a harmonic music signal or singing voice signal is smaller than the minimum lag limitation PIT_MIN defined in CELP algorithm, the transmitted lag may be double, triple or multiple of the real pitch lag. FIG. 8 shows an example of a spectrum 800 of the same signal with doubling pitch lag coding (the coded and transmitted pitch lag is double of the real pitch lag). The spectrum 800 comprises harmonic peaks 801, a spectral envelope 802, and unwanted small peaks between the real harmonic peaks. The small spectrum peaks in FIG. 8 may cause uncomfortable perceptual distortion.

System and method embodiments are provided herein to avoid the potential problem above of pitch coding for VOICED class or GENERIC class. The system and method embodiments are configured to code a pitch lag in a range starting from a substantially short value PIT_MIN0 (PIT_MIN0<PIT_MIN), which may be predefined. The system and method include detecting whether there is a very short pitch in a speech or audio signal (e.g., of 4 subframes) using a combination of time domain and frequency domain procedures, e.g., using a pitch correlation function and energy spectrum analysis. Upon detecting the existence of a very short pitch, a suitable very short pitch value in the range from PIT_MIN0 to PIT_MIN may then be determined.

Typically, music harmonic signals or singing voice signals are more stationary than normal speech signals. The pitch lag (or fundamental frequency) of a normal speech signal may keep changing over time. However, the pitch lag (or fundamental frequency) of music signals or singing voice signals may change relatively slowly over relatively long time duration. For substantially short pitch lag, it is useful to have a precise pitch lag for efficient coding purpose. The substantially short pitch lag may change relatively slowly from one subframe to a next subframe. This means that a relatively large dynamic range of pitch coding is not needed when the real pitch lag is substantially short. Accordingly, one pitch coding mode may be configured to define high precision with relatively less dynamic range. This pitch coding mode is used to code substantially or relatively short pitch signals or substantially stable pitch signals having a relatively small pitch difference between a previous subframe and a current subframe.

The substantially short pitch range is defined from PIT_MIN0 to PIT_MIN. For example, at the sampling frequency Fs=12.8 kHz, the definition of the substantially short pitch range can be PIT_MIN0=17 and PIT_MIN=34. When the pitch candidate is substantially short, pitch detection using a time domain only or a frequency domain only approach may not be reliable. In order to reliably detect a short pitch value, three conditions may need to be checked: (1) in frequency domain, the energy from 0 Hz to $F_{MIN}$=Fs/PIT_MIN Hz is relatively low enough; (2) in time domain, the maximum pitch correlation in the range from PIT_MIN0 to PIT_MIN is relatively high enough compared to the maximum pitch correlation in the range from PIT_MIN to PIT_MAX; and (3) in time domain, the maximum normalized pitch correlation in the range from PIT_MIN0 to PIT_MIN is high enough toward 1. These three conditions are more important than other conditions, which may also be added, such as Voice Activity Detection and Voiced Classification.

For a pitch candidate P, the normalized pitch correlation may be defined in mathematical form as, $$R(P) = \frac{\sum_n s_w(n) \cdot s_w(n-P)}{\sqrt{\sum_n \|s_w(n)\|^2 \cdot \sum_n \|s_w(n-P)\|^2}}. \quad (5)$$

In (5), $s_w(n)$ is a weighted speech signal, the numerator is correlation, and the denominator is an energy normalization factor. Let Voicing be the average normalized pitch correlation value of the four subframes in the current frame:

$$\text{Voicing}=[R_1(P_1)+R_2(P_2)+R_3(P_3)+R_4(P_4)]/4 \quad (6)$$

where $R_1(P_1)$, $R_2(P_2)$, $R_3(P_3)$, and $R_4(P_4)$ are the four normalized pitch correlations calculated for each subframe, and $P_1$, $P_2$, $P_3$, and $P_4$ for each subframe are the best pitch candidates found in the pitch range from P=PIT_MIN to P=PIT_MAX. The smoothed pitch correlation from previous frame to current frame can be $$\text{Voicing_}sm \Leftarrow (3\cdot\text{Voicing_}sm+\text{Voicing})/4. \quad (7)$$

Using an open-loop pitch detection scheme, the candidate pitch may be multiple-pitch. If the open-loop pitch is the right one, a spectrum peak exists around the corresponding pitch frequency (the fundamental frequency or the first harmonic frequency) and the related spectrum energy is relatively large. Further, the average energy around the corresponding pitch frequency is relatively large. Otherwise, it is possible that a substantially short pitch exits. This step can be combined with a scheme of detecting lack of low frequency energy described below to detect the possible substantially short pitch.

In the scheme for detecting lack of low frequency energy, the maximum energy in the frequency region [0, $F_{MIN}$] (Hz) is defined as Energy0 (dB), the maximum energy in the frequency region [$F_{MIN}$, 900] (Hz) is defined as Energy1 (dB), and the relative energy ratio between Energy0 and Energy1 is defined as $$\text{Ratio}=\text{Energy1}-\text{Energy0}. \quad (8)$$

This energy ratio can be weighted by multiplying an average normalized pitch correlation value Voicing:

$$\text{Ratio} \Leftarrow \text{Ratio}\cdot\text{Voicing}. \quad (9)$$

The reason for doing the weighting in (9) by using Voicing factor is that short pitch detection is meaningful for voiced speech or harmonic music, but may not be meaningful for unvoiced speech or non-harmonic music. Before using the Ratio parameter to detect the lack of low frequency energy, it is beneficial to smooth the Ratio parameter in order to reduce the uncertainty:

$$LF_\text{EnergyRatio}_sm \Leftarrow (15\cdot LF_\text{EnergyRatio}_sm+\text{Ratio})/16. \quad (10)$$

Let LF_lack_flag=1 designate that the lack of low frequency energy is detected (otherwise LF_lack_flag=0), the value LF_lack_flag can be determined by the following procedure A:

```
If (LF_EnergyRatio_sm>35 or Ratio>50 ) {
    LF_lackflag=1 ;
}
If (LF_EnergyRatio_sm <16) {
    LF_lackflag=0 ;
}
```

If the above conditions are not satisfied, LF_lack_flag keeps unchanged.

An initial substantially short pitch candidate Pitch_Tp can be found by maximizing the equation (5) and searching from P=PIT_MIN0 to PIT_MIN, $$R(\text{Pitch_}Tp)=\text{MAX}\{R(P), P=\text{PIT_MIN0}, \ldots, \text{PIT_MIN}\}. \quad (11)$$

If Voicing0 represents the current short pitch correlation, $$\text{Voicing0}=R(\text{Pitch_}Tp), \quad (12)$$

then the smoothed short pitch correlation from previous frame to current frame can be $$\text{Voicing0_}sm \Leftarrow (3\cdot\text{Voicing0_}sm+\text{Voicing0})/4 \quad (13)$$

By using the available parameters above, the final substantially short pitch lag can be decided with the following procedure B:

```
If ( (coder_type is not UNVOICED or TRANSITION) and
     (LF_lack_flag=1) and (VAD=1) and
     (Voicing0_sm>0.7) and (Voicing0_sm>0.7 Voicing_sm) )
{
  Open_Loop_Pitch = Pitch_Tp;
  stab_pit_flag = 1;
  coder_type = VOICED;
}
```

In the above procedure, VAD means Voice Activity Detection.

Figure 9:
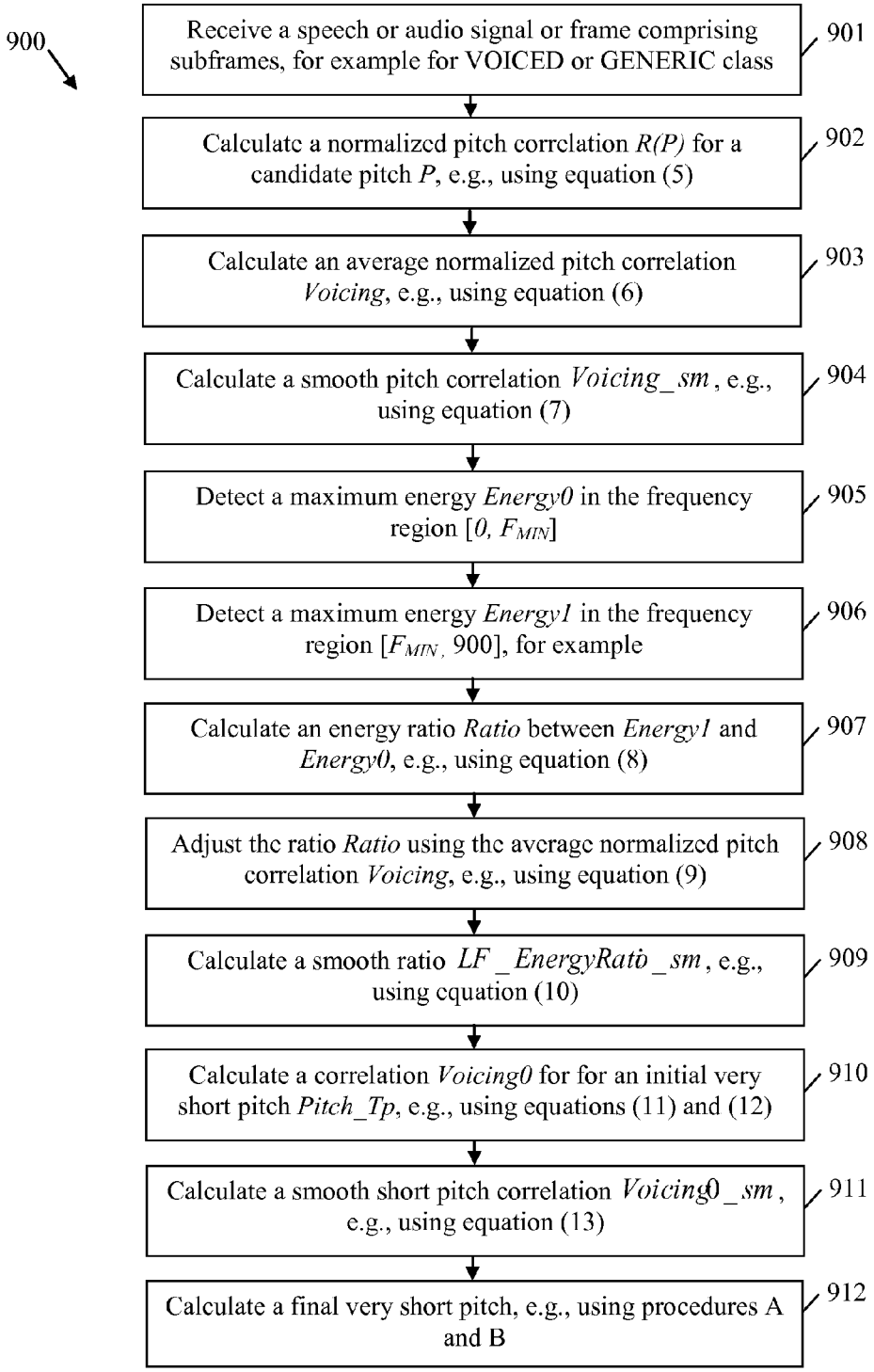
FIG. 9 shows an embodiment method for very short pitch lag detection and coding for a speech or voice signal.

FIG. 9 shows an embodiment method 900 for very short pitch lag detection and coding for a speech or audio signal. The method 900 may be implemented by an encoder for speech/audio coding, such as the encoder 300 (or 100). A similar method may also be implemented by a decoder for speech/audio coding, such as the decoder 400 (or 200). At step 901, a speech or audio signal or frame comprising 4 subframes is classified, for example for VOICED or GENERIC class. At step 902, a normalized pitch correlation R(P) is calculated for a candidate pitch P, e.g., using equation (5). At step 903, an average normalized pitch correlation Voicing is calculated, e.g., using equation (6). At step 904, a smooth pitch correlation Voicing_sm is calculated, e.g., using equation (7). At step 905, a maximum energy Energy0 is detected in the frequency region [0, $F_{MIN}$]. At step 906, a maximum energy Energy1 is detected in the frequency region [$F_{MIN}$, 900], for example. At step 907, an energy ratio Ratio between Energy1 and Energy0 is calculated, e.g., using equation (8). At step 908, the ratio Ratio is adjusted using the average normalized pitch correlation Voicing, e.g., using equation (9). At step 909, a smooth ratio LF_EnergyRatio_sm is calculated, e.g., using equation (10). At step 910, a correlation Voicing0 for an initial very short pitch Pitch_Tp is calculated, e.g., using equations (11) and (12). At step 911, a smooth short pitch correlation Voicing0_sm is calculated, e.g., using equation (13). At step 912, a final very short pitch is calculated, e.g., using procedures A and B.

Signal to Noise Ratio (SNR) is one of the objective test measuring methods for speech coding.

Weighted Segmental SNR (WsegSNR) is another objective test measuring method, which may be slightly closer to real perceptual quality measuring than SNR. A relatively small difference in SNR or WsegSNR may not be audible, while larger differences in SNR or WsegSNR may more or clearly audible. Tables 1 and 2 show the objective test results with/without introducing very short pitch lag coding. The tables show that introducing very short pitch lag coding can significantly improve speech or music coding quality when signal contains real very short pitch lag. Additional listening test results also show that the speech or music quality with real pitch lag<=PIT_MIN is significantly improved after using the steps and methods above.

TABLE 1

SNR for clean speech with real pitch lag <= PIT_MIN.

| | 6.8 kbps | 7.6 kbps | 9.2 kbps | 12.8 kbps | 16 kbps |
|---|---|---|---|---|---|
| No Short Pitch | 5.241 | 5.865 | 6.792 | 7.974 | 9.223 |
| With Short Pitch | 5.732 | 6.424 | 7.272 | 8.332 | 9.481 |
| Difference | 0.491 | 0.559 | 0.480 | 0.358 | 0.258 |

TABLE 2

WsegSNR for clean speech with real pitch lag <= PIT_MIN.

| | 6.8 kbps | 7.6 kbps | 9.2 kbps | 12.8 kbps | 16 kbps |
|---|---|---|---|---|---|
| No Short Pitch | 6.073 | 6.593 | 7.719 | 9.032 | 10.257 |
| With Short Pitch | 6.591 | 7.303 | 8.184 | 9.407 | 10.511 |
| Difference | 0.528 | 0.710 | 0.465 | 0.365 | 0.254 |

Figure 10:
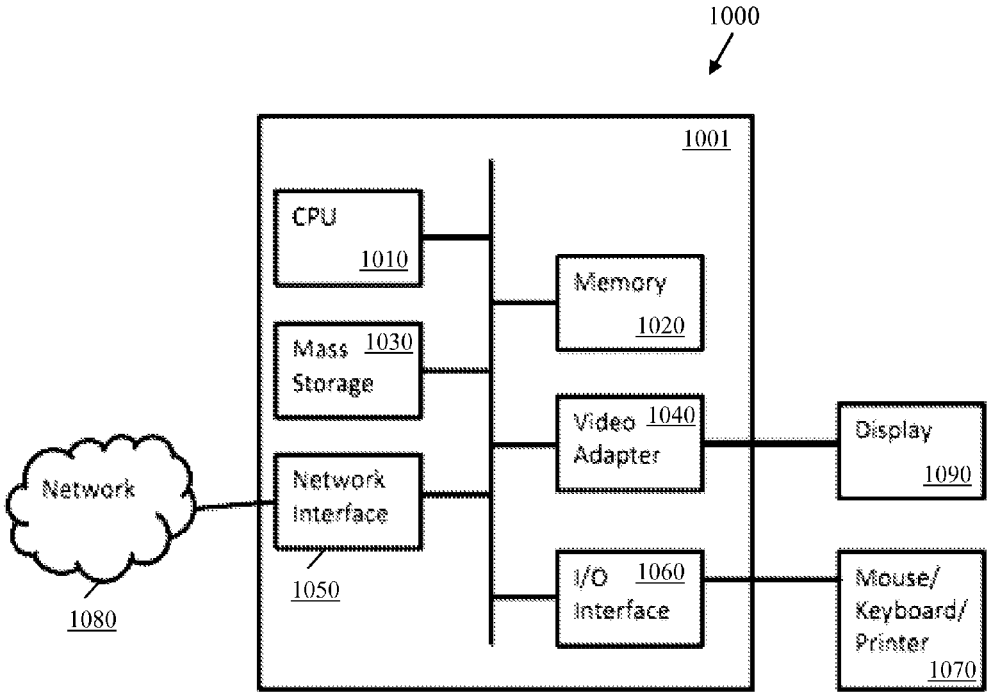
FIG. 10 is a block diagram of a processing system that can be used to implement various embodiments.

FIG. 10 is a block diagram of an apparatus or processing system 1000 that can be used to implement various embodiments. For example, the processing system 1000 may be part of or coupled to a network component, such as a router, a server, or any other suitable network component or apparatus. Specific devices may utilize all of the components shown, or only a subset of the components, and levels of integration may vary from device to device. Furthermore, a device may contain multiple instances of a component, such as multiple processing units, processors, memories, transmitters, receivers, etc. The processing system 1000 may comprise a processing unit 1001 equipped with one or more input/output devices, such as a speaker, microphone, mouse, touchscreen, keypad, keyboard, printer, display, and the like. The processing unit 1001 may include a central processing unit (CPU) 1010, a memory 1020, a mass storage device 1030, a video adapter 1040, and an I/O interface 1060 connected to a bus. The bus may be one or more of any type of several bus architectures including a memory bus or memory controller, a peripheral bus, a video bus, or the like.

The CPU 1010 may comprise any type of electronic data processor. The memory 1020 may comprise any type of system memory such as static random access memory (SRAM), dynamic random access memory (DRAM), synchronous DRAM (SDRAM), read-only memory (ROM), a combination thereof, or the like. In an embodiment, the memory 1020 may include ROM for use at boot-up, and DRAM for program and data storage for use while executing programs. In embodiments, the memory 1020 is non-transitory. The mass storage device 1030 may comprise any type of storage device configured to store data, programs, and other information and to make the data, programs, and other information accessible via the bus. The mass storage device 1030 may comprise, for example, one or more of a solid state drive, hard disk drive, a magnetic disk drive, an optical disk drive, or the like.

The video adapter 1040 and the I/O interface 1060 provide interfaces to couple external input and output devices to the processing unit. As illustrated, examples of input and output devices include a display 1090 coupled to the video adapter 1040 and any combination of mouse/keyboard/printer 1070 coupled to the I/O interface 1060. Other devices may be coupled to the processing unit 1001, and additional or fewer interface cards may be utilized. For example, a serial interface card (not shown) may be used to provide a serial interface for a printer.

The processing unit 1001 also includes one or more network interfaces 1050, which may comprise wired links, such as an Ethernet cable or the like, and/or wireless links to access nodes or one or more networks 1080. The network interface 1050 allows the processing unit 1001 to communicate with remote units via the networks 1080. For example, the network interface 1050 may provide wireless communication via one or more transmitters/transmit antennas and one or more receivers/receive antennas. In an embodiment, the processing unit 1001 is coupled to a local-area network or a wide-area network for data processing and communications with remote devices, such as other processing units, the Internet, remote storage facilities, or the like.

While this invention has been described with reference to illustrative embodiments, this description is not intended to be construed in a limiting sense. Various modifications and combinations of the illustrative embodiments, as well as other embodiments of the invention, will be apparent to persons skilled in the art upon reference to the description. It is therefore intended that the appended claims encompass any such modifications or embodiments.

What is claimed is:

1. A method for pitch detection and coding implemented by an apparatus for speech or audio coding, the method comprising:

detecting in a speech or an audio signal a pitch lag shorter than a first minimum pitch limitation, predetermined for a range to encode the speech or the audio signal, using a combination of time domain and frequency domain pitch detection techniques including using pitch correlation and detecting a lack of low frequency energy; and coding the pitch lag for the speech or the audio signal in a range from a second minimum pitch limitation to the first minimum pitch limitation, wherein the second minimum pitch limitation is smaller than the first minimum pitch limitation.

2. The method of claim 1, wherein detecting the pitch lag using the combination of time domain and frequency domain pitch detection techniques comprises:

calculating a normalized pitch correlation using a candidate pitch and a weighted speech signal or audio signal; and calculating an average normalized pitch correlation using the normalized pitch correlation.

3. The method of claim 2, wherein detecting the pitch lag using the combination of time domain and frequency domain pitch detection techniques further comprises:

detecting a first energy of the speech or the audio signal in a first frequency region from zero to a predetermined minimum frequency and a second energy of the speech signal in a second frequency region from the predetermined minimum frequency to a predetermined maximum frequency; and calculating an energy ratio between the first energy and the second energy.

4. The method of claim 3, wherein detecting the pitch lag using the combination of time domain and frequency domain pitch detection techniques further comprises:

adjusting the energy ratio using the average normalized pitch correlation; and calculating a smooth energy ratio using the adjusted energy ratio.

5. The method of claim 4, wherein detecting the pitch lag using the combination of time domain and frequency domain pitch detection techniques further comprises:

calculating a correlation for an initial pitch lag candidate; and calculating a smooth short pitch correlation using the correlation for the initial pitch lag candidate.

6. The method of claim 5, wherein detecting the pitch lag using the combination of time domain and frequency domain techniques further comprises calculating a final pitch lag according to the smooth energy ratio and the smooth short pitch correlation.

7. The method of claim 1, wherein the first minimum pitch limitation is equal to 34 for 12.8 kilohertz (kHz) sampling frequency.

8. The method of claim 1, wherein the first minimum pitch limitation corresponds to a Code Excited Linear Prediction Technique (CELP) algorithm standard.

9. A method for pitch detection and coding implemented by an apparatus for speech or audio coding, the method comprising:

detecting in time domain a pitch lag of a speech or an audio signal shorter than a first minimum pitch limitation, predetermined for a range to encode the speech or the audio signal, by using pitch correlations;

further detecting the existence of the pitch lag in frequency domain by detecting a lack of low frequency energy in the speech or the audio signal; and coding the pitch lag for the speech or the audio signal using a pitch range starting from a second minimum pitch limitation instead of the first minimum pitch limitation, wherein the second minimum pitch limitation is smaller than the first minimum pitch limitation.

10. The method of claim 9 further comprising calculating a normalized pitch correlation for a candidate pitch as $$R(P) = \frac{\sum_n s_w(n) \cdot s_w(n-P)}{\sqrt{\sum_n \|s_w(n)\|^2 \cdot \sum_n \|s_w(n-P)\|^2}},$$

where R(P) is the normalized pitch correlation, P is to candidate pitch, and $s_w(n)$ is a weighted speech signal.

11. The method of claim 10 further comprising calculating an average normalized pitch correlation as $$\text{Voicing}=[R_1(P_1)+R_2(P_2)+R_3(P_3)+R_4(P_4)]/4,$$

where Voicing is the average normalized pitch correlation, $R_1(P_1)$, $R_2(P_2)$, $R_3(P_3)$, and $R_4(P_4)$ are four normalized pitch correlations calculated for four respective subframes of a frame of the speech or audio signal, and $P_1$, $P_2$, $P_3$, and $P_4$ are four pitch candidates for the four respective subframes.

12. The method of claim 11 further comprising calculating a smooth pitch correlation as $$\text{Voicing_}sm<=(3\cdot\text{Voicing_}sm+\text{Voicing})/4$$

where Voicing_sm is the smooth pitch correlation.

13. The method of claim 12, wherein detecting a lack of low frequency energy further comprises calculating an energy ratio as $$\text{Ratio}=\text{Energy1}-\text{Energy0},$$

where Ratio is the energy ratio, Energy0 is a first detected energy in decibel (dB) in a first frequency region [0, $F_{MIN}$] Hz, Energy1 is a second detected energy in dB in a second frequency region [$F_{MIN}$, 900] Hertz (Hz), and $F_{MIN}$ is a predetermined minimum frequency.

14. The method of claim 13 further comprising adjusting the energy ratio using the average normalized pitch correlation as $$\text{Ratio}<=\text{Ratio}\cdot\text{Voicing}.$$

15. The method of claim 14 further comprising calculating a smooth ratio as $$LF_\text{EnergyRatio_}sm<=(15\cdot LF_\text{EnergyRatio_}sm+\text{Ratio})/16,$$

where LF_EnergyRatio_sm is the smooth ratio.

16. The method of claim 15 further comprising calculate a correlation for an initial pitch lag candidate as $$\text{Voicing0}=R(\text{Pitch_}Tp)=\text{MAX}\{R(P),\ P=\text{PIT_MIN0},\ldots,\text{PIT_MIN}\},$$

where Voicing0 is the correlation, Pitch_Tp is the initial pitch lag candidate, PIT_MIN0 is the second minimum pitch limitation, and PIT_MIN is the first minimum pitch limitation.

17. The method of claim 16 further comprising calculating a smooth short pitch correlation as $$\text{Voicing0_}sm<=(3\cdot\text{Voicing0_}sm+\text{Voicing0})/4,$$

where Voicing0_sm is the smooth short pitch correlation.

18. The method of claim 17 further comprising calculating a final pitch lag as $$\text{Open_Loop_Pitch}=\text{Pitch_}Tp;$$

where Open_Loop_Pitch is the final pitch lag, the speech signal does not belong to UNVOICED class or TRANSITION, LF_EnergyRatio_sm>35 or Ratio>50, and both (Voicing0_sm>0.7) and (Voicing0_sm>0.7 Voicing_sm).

19. The method of claim 9, wherein the first minimum pitch limitation is equal to 34 for a standard Code Excited Linear Prediction Technique (CELP) algorithm.

20. An apparatus that supports pitch detection and coding for speech or audio coding, comprising:

a processor; and a computer readable storage medium storing programming for execution by the processor, the programming including instructions to:

detect in a speech signal or an audio signal a pitch lag shorter than a first minimum pitch limitation, predetermined for a range to encode the speech or the audio signal, using a combination of time domain and frequency domain pitch detection techniques including using pitch correlation and detecting a lack of low frequency energy; and code the pitch lag for the speech signal or the audio signal in a range from a second minimum pitch limitation to the first minimum pitch limitation, wherein the second minimum pitch limitation is smaller than the first minimum pitch limitation.

21. The apparatus of claim 20, wherein the speech or the audio signal belongs to VOICED or GENERIC class and comprises at most 4 subframes.

22. The apparatus of claim 20, wherein the first minimum pitch limitation is equal to 34 for a standard Code Excited Linear Prediction Technique (CELP) algorithm.

* * * * *